US005085978A

United States Patent [19]

Kajiwara et al.

[11] Patent Number: 5,085,978

[45] Date of Patent: Feb. 4, 1992

[54] METHOD FOR PROCESSING LIGHT-SENSITIVE SILVER HALIDE PHOTOGRAPHIC MATERIAL

[75] Inventors: Makoto Kajiwara; Toyoki Nishijima; Shigeo Chino, all of Odawara, Japan

[73] Assignee: Konica Corporation, Tokyo, Japan

[21] Appl. No.: 602,801

[22] Filed: Oct. 24, 1990

[30] Foreign Application Priority Data

Oct. 25, 1989 [JP] Japan ..... 277644

[51] Int. Cl.[5] ..... G03C 5/26; G03C 7/30

[52] U.S. Cl. ..... 430/374; 430/434; 430/464; 430/559; 430/933

[58] Field of Search ..... 430/268, 399, 559, 560, 430/566, 631, 933, 374, 434, 464, 486

[56] References Cited

U.S. PATENT DOCUMENTS

| | | | |
|---|---|---|---|
| 3,822,129 | 7/1974 | Dunn et al. . | |
| 4,797,351 | 1/1989 | Ishikawa et al. | 430/399 |
| 4,906,554 | 3/1990 | Ishikawa et al. | 430/434 |
| 4,912,023 | 3/1990 | Matsuyama et al. | 430/950 |
| 4,920,042 | 4/1990 | Waki et al. | 430/585 |
| 4,948,713 | 8/1990 | Kobayashi et al. | 430/434 |

FOREIGN PATENT DOCUMENTS

| | | |
|---|---|---|
| 0201033 | 11/1986 | European Pat. Off. . |
| 0243966 | 10/1987 | European Pat. Off. . |
| 0289008 | 2/1988 | European Pat. Off. . |
| 2156330 | 5/1973 | France . |
| 54-94318 | 7/1979 | Japan . |

*Primary Examiner*—Hoa Van Le

*Attorney, Agent, or Firm*—Finnegan, Henderson, Farabow, Garrett and Dunner

[57] ABSTRACT

Disclosed is a method for processing a light-sensitive silver halide photographic material having at least one silver halide emulsion layer on a reflective support, characterized in that at least one layer of the silver halide emulsion layer contains a compound represented by the formula (I) shown below, and the light-sensitive silver halide photographic material with a total amount of a hydrophilic binder contained of 7.5 g/m$^2$ or less is processed with a color developer with an amount of the color developer replenished of 25 to 100 ml per 1 m$^2$ of the light-sensitive silver halide photographic material:

Formula (I)

wherein A, $R_1$, $R_2$, $R_3$, $R_4$, $X_1$ and $X_2$ are as described in the description.

11 Claims, No Drawings

METHOD FOR PROCESSING LIGHT-SENSITIVE SILVER HALIDE PHOTOGRAPHIC MATERIAL

BACKGROUND OF THE INVENTION

This invention relates to a method for processing a light-sensitive silver halide photographic material, particularly to a method for processing a light-sensitive silver halide photographic material with a remarkably reduced amount of color developer replenished.

Processing of a light-sensitive silver halide photographic material (hereinafter sometimes abbreviated merely as light-sensitive material) comprises basically color developing and desilverization steps, and the desilverization step comprises bleaching and fixing steps or one bath bleach-fixing step. If necessary, other processing steps, namely water washing, stopping processing, stabilizing processing, etc. may be added.

In color developing, the silver halide exposed is reduced to silver with a developing agent. At the same time, halide ions are dissolved out into the developer to be accumulated therein. Otherwise, organic compounds such as inhibitors or stabilizers, etc. added to the light-sensitive material are dissolved out into the developer to be accumulated therein.

On the other hand, the developing agent after reducing silver halide is consumed by the reaction with the coupler, or otherwise, there are also components brought out as held in the light-sensitive material, whereby the concentration in the developer is lowered. For this reason, in the developing processing method in which a large amount of silver halide light-sensitive materials are continuously processed by an automatic developing machine, for avoiding change in photographic performances due to the change in component concentration of the developer as mentioned above, replenishing with a replenishing solution is ordinarily performed in order to maintain the concentration at a constant range. However, by such replenishment, a large amount of overflowed solution is necessarily generated, which poses a great problem in economy as well as in pollution.

In recent years, reduction of the amount replenished of a color developer has been strongly demanded from the standpoints of energy saving, lowering in cost and lowering in pollution.

However, when the amount of the replenishing solution is merely reduced, there will ensue a great problem that the substances dissolved out from the light-sensitive material are accumulated at high concentrations. More specifically, substances dissolved out include halide ions which are developing inhibitors and various organic compounds, and increased concentrations of these will result in lowering of developing activity. Also, by accumulation at a high concentration of sensitizing dyes and coloration components such as dyes added for irradiation or halation prevention, the light-sensitive material is stained. This problem will lead to a serious problem of coloration of the white ground portion particularly in the light-sensitive material for print, whereby image quality is remarkably damaged.

As the means for solving such problems, improvements of developers have been attempted. For example, for the purpose of improving developing activity, pH or temperature of the developer is made higher, or for the purpose of reducing halide ions, there are the methods as described in Japanese Unexamined Patent Publication Nos. 95345/1983, 232342/1984, 70552/1986, International Published Patent WO 87-04534, etc., but all of them have not attained sufficient effect, partly because of troubles caused such as accompaniment of increased fogging, deterioration of stability of developer, etc.

On the other hand, for the purpose of improving the above problems from the standpoint of light-sensitive material design, the effect by reduction of a hydrophilic binder contained in the light-sensitive material is expected. Practically, by reduction of a hydrophilic binder, a great effect in improvement of developing speed can be recognized to be exhibited, but with respect to improvement of white ground with a low replenishing solution, its effect cannot be said to be satisfactory, and further improvement is desirable.

In Japanese Unexamined Patent Publications Nos. 180939/-1982, 182611/1982, 183444/1982, techniques of white ground improvement with fluorescent brighteners are disclosed, and these are very effective means. However, as described in the above-mentioned patents, for these compounds to act effectively in small amounts, presence of a hydrophilic polymer such as polyvinyl pyrrolidone is required, but the hydrophilic polymer has little improvement effect of white ground in development processing with a low Replenished processing liquor in which coloration components are accumulated at high concentration, but rather there is a fear of bad influence therefrom, and in most cases use of such polymer may be preferably avoided. As a consequence, it becomes necessary to use a large amount of the above-mentioned brighteners. If these brighteners are used in large amounts, the desilverization step subsequent to the developing step tends to be badly affected thereby, and this tendency becomes more intensified in the case of processing with low level of replenished processing solution, whereby the improvement of this problem becomes necessary.

SUMMARY OF THE INVENTION

An object of the present invention is to provide a method for processing a light-sensitive silver halide photographic material which is free from deterioration of white ground and defective desilverization when the amount of a color developer replenished may be markedly reduced.

The above object of the present invention can be accomplished by a method for processing a light-sensitive silver halide photographic material having at least one silver halide emulsion layer on a reflective support, characterized in that at least one layer of said silver halide emulsion layer contains a compound represented by the formula (I) shown below, and the light-sensitive silver halide photographic material with a total amount of a hydrophilic binder contained of 7.5 g/m$^2$ or less is processed with a color developer with an amount of the color developer replenished of 25 to 100 ml per 1 m$^2$ of said light-sensitive silver halide material:

Formula (I)

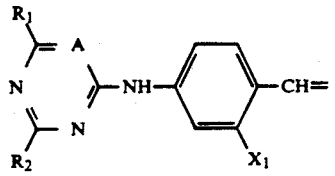

-continued

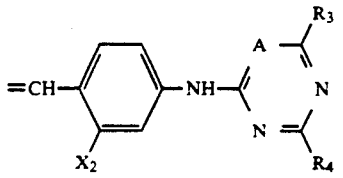

wherein A represents

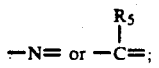

$R_1$, $R_2$, $R_3$ and $R_4$, which may be the same or different, each represent a substituted or unsubstituted alkyl group, a substituted or unsubstituted alkylamino group, a substituted or unsubstituted arylamino group or a substituted or unsubstituted aryloxy group; R5 represents a substituent; $X_1$ and $X_2$ each represent hydrogen atom or $—SO_3M$ group, M represents hydrogen atom or an atom or a group of atoms forming a water-soluble salt; the sum of $—SO_3M$ groups in the compound is 1 to 6.

DETAILED DESCRIPTION OF THE INVENTION

First, the compound represented by the formula [I] to be used in the present invention is described.

In the formula [I], $R_1$, $R_2$, $R_3$ and $R_4$, which may be the same or different, each represent a substituted or unsubstituted alkyl group (e.g. 2-ethylaminoethyl, ethyl), a substituted or unsubstituted alkylamino group (e.g. N,N-diethylamino, N,N-di-2-hydroxyethylamino), a substituted or unsubstituted arylamino group (e.g. phenylamino), a substituted or unsubstituted aryloxy group (e.g. phenoxy).

$R_5$ is not particularly limited, provided that it is a group which can be substituted on pyrimidine ring.

When $X_1$ and $X_2$ represent $—SO_3M$ group, M represent hydrogen atom or an atom or a group of atoms [e.g. $—NH_4$, alkali metal (Na, K, etc.)]forming a water soluble salt.

Including those substituted on $R_1$, $R_2$, $R_3$ and $R_4$, the compound has 1 to 6 $—SO_3M$ groups therein. When the sum of $—SO_3M$ groups in the compound is above 6, the effect of the present invention is reduced.

Next, specific examples of the compound represented by the above formula [I] are shown, but the present invention is not limited to these at all.

1

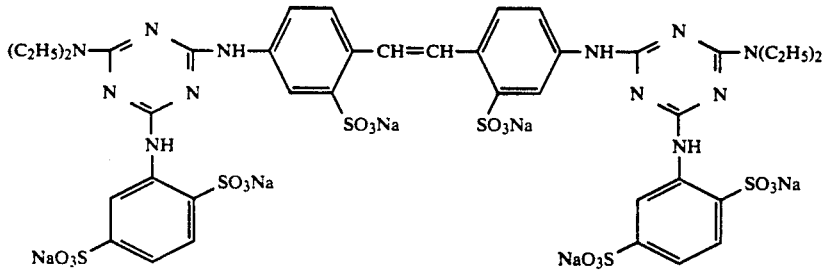

2

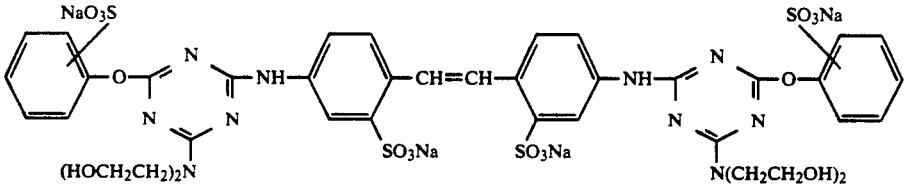

3

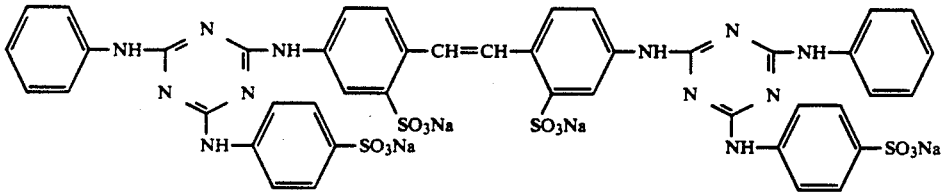

4

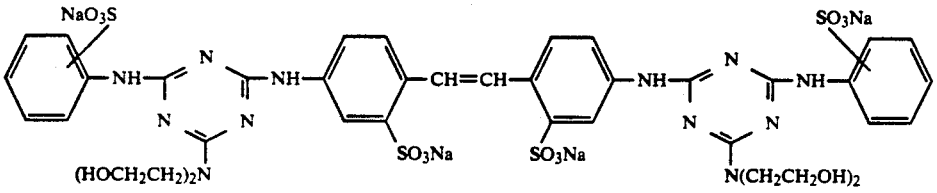

-continued

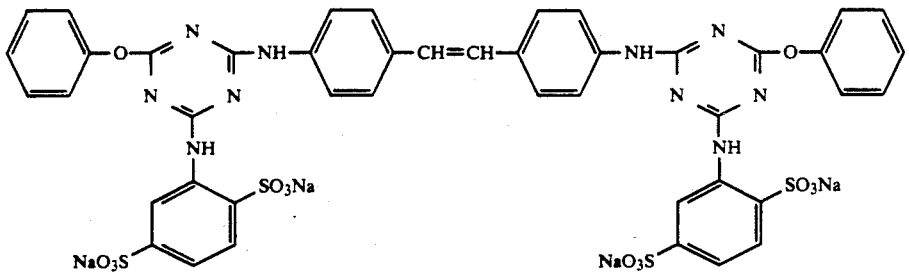

6

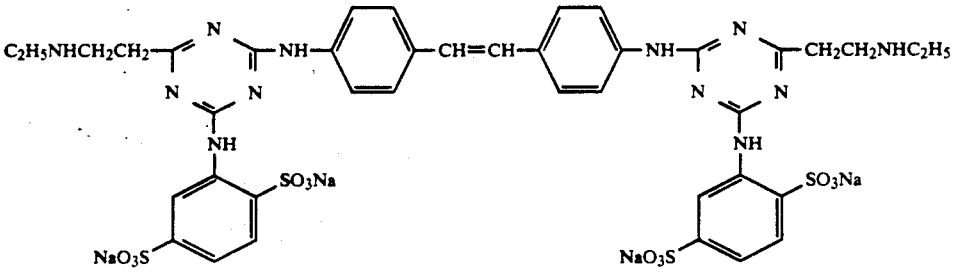

7

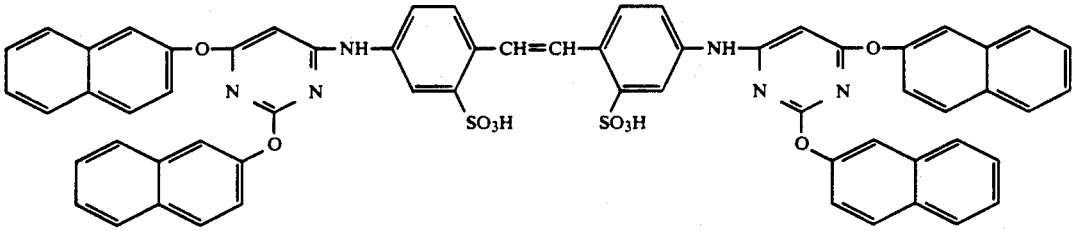

The diaminostilbene type brightener represented by the above formula [I] can be synthesized by conventional method as described on page 8 in "Keiko Zohakuzai (fluorescent brightener)" edited by Kaseihin Kogyo Kyokai (published in August, 1976).

These compounds of the formula [I] can be contained in any of the constituent layers of the light-sensitive silver halide material according to the present invention, but as a preferable embodiment, in the non-emulsion layer of the constituent layers of the light-sensitive silver halide material.

The amount added can be varied widely, but may be generally 0.01 to 3.0 mg/dm$^2$, more preferably 0.1 to 2.0 mg/dm$^2$.

As the hydrophilic binder in the silver halide emulsion layer and the non-light-sensitive layer of the present invention, gelatin is useful, but hydrophilic colloids such as gelatin derivatives, graft polymers of gelatin with other polymers, other proteins, sugar derivatives, cellulose derivatives, synthetic hydrophilic polymeric substances such as homo- or co-polymers can be also used.

As gelatin, in addition to lime-treated gelatin, acid-treated gelatin or enzyme-treated gelatin as described in Bulletin of Society of Science of Photography of Japan (Bull. Soc. Sci. Phot. Japan) No. 16, p. 30 (1966) may be also used, and also hydrolyzates or enzyme decomposed products of gelatin can be used.

As the gelatin derivative, there may be employed those obtained by reacting gelatin with various compounds such as acid halide, acid anhydride, isocyanates, bromoacetic acid, alkanesultones, vinylsulfonamides, maleinimide compounds, polyalkylene oxides, epoxy compounds, etc. Their specific examples are described in U.S. Pat. Nos. 2,614,928, 3,132,945, 3,186,846, 3,312,553, U.K. Patents 861,414, 1,033,189, 1,005,784, Japanese Patent Publication No. 26845/1967, etc.

Preferable as the protein are albumin, casein; as cellulose derivatives, hydroxyethyl cellulose, carboxymethyl cellulose, sulfuric acid esters of cellulose; as sugar derivatives, sodium alginate, starch derivatives.

As the graft polymer of the above-mentioned gelatin with other polymers, there can be employed those having vinyl monomers such as acrylic acid, methacrylic acid, derivatives such as ester, amide, etc. of them, acrylonitrile, styrene, etc. singly or in a plural number grafted to gelatin. Especially, graft polymers with polymers compatible to some extent with gelatin, such as acrylic acid, acrylamide, methacrylamide, hydroxyalkyl methacrylate, etc. are preferred. Examples of these are described in U.S. Pat. Nos. 2,763,625, 2,831,767, 2,956,884, etc.

Representative synthetic hydrophilic polymeric substances may include homo- or co-polymers such as polyvinyl alcohol, polyvinyl alcohol partial acetal, poly-N-vinyl pyrrolidone, polyacrylic acid, polymethacrylic acid, polyacrylamide, polyvinyl imidazole, polyvinyl pyrazole, etc., as described in German Patent Application (OLS) 2,312,708, U.S. Pat. Nos. 3,620,751, 3,879,205, Japanese Patent Publication No. 7561/1968.

The total amount of the hydrophilic binder according to the present invention is not particularly limited, provided that it is 7.5 g/m$^2$ or less, because the effect of the present invention can be obtained, but an amount for permitting the roles as a protective colloid of silver halide grains and hydrophobic oily components to be fulfilled at least minimum is required, which depends on the kind of the light-sensitive material.

The color developing agent to be used in the present invention may include known ones widely employed in various color photographic processes. These developing agents include aminophenol type and p-phenylenediamine type derivatives. These compounds may generally employed in the form of salt, for example, in the form of hydrochloride or sulfate, because of more stability than under free state. These compounds may be generally employed at a concentration of about 0.1 g to about 30 g per one liter of color developing solution, preferably at a concentration of about 1 g to about 15 g per one liter of color developing solution.

Examples of aminophenol type developing agent may include o-aminophenol, p-aminophenol, 5-amino-2-hydroxytoluene, 2-amino-3-hydroxytoluene, 2-hydroxy-3-amino-1,4-benzene, etc.

Particularly useful primary aromatic amine type color developing agents are N,N-dialkyl-p-phenylenediamine type compounds, of which alkyl group and phenyl group may be also substituted with any substituent. Among them, particularly useful compound examples may include N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)toluene, N-ethyl-N-β-methanesulfonamido-ethyl-3-methyl-4-aminoaniline sulfate, N-ethyl-N-β-hydroxyethyl-aminoaniline, 4-amino-3-methyl-N,N-diethylaniline, 4-amino-N-(2-methoxyethyl)-N-ethyl-3-methylaniline-p-toluene-sulfonate, etc.

In the developer to be applied for processing of the light-sensitive silver halide photographic material of the present invention, in addition to the developing agent as described above, known developer component compounds can be added. For example, there can be added alkali agents such as sodium hydroxide, potassium carbonate, etc., alkali metal sulfites, alkali metal bisulfites, alkali metal thiocyanates, alkali metal halides, benzyl alcohol, water softeners and thickeners, as desired.

The temperature of the developer may be 15° C. or higher, generally 20 to 50° C., preferably 30° C. for rapid processing. The pH value of the developer may be ordinarily higher, most generally about 10 to about 13.

The replenishing amount has been desired to be reduced so far as possible for the reasons as mentioned above, and 100 ml/m$^2$-sensitive material is an amount which has realized further lowered replenishing amount from the amount achieved in the prior art. It is inevitable that the light-sensitive material when subjected to development processing brings out the processing liquor held thereon, and therefore at least replenishment of this amount is necessary. This amount depends on the structure of the photographic constituent layers of the light-sensitive material and ability of the developing machine such as conveying speed or squeezing ability, but an amount of 25 ml/m$^2$-sensitive material indicates the amount brought out inevitably generated.

The light-sensitive silver halide photographic material according to the present invention contains these color developing agents as the color developing agent itself or as the precursor thereof in the hydrophilic colloidal layer, and can be also processed with an alkaline activated bath. The color developing agent precursor is a compound capable of forming a color developing agent under alkaline conditions, and may include Schiff's base type precursors with aromatic aldehyde derivatives, polyvalent metal ion complex precursors, phthalic acid imide derivative precursors, phosphoric acid amide precursors, sugar amine reaction product precursors, urethane type precursors, etc. The precursors of these aromatic primary amine color developing agents are described in, for example, U.S. Pat. Nos. 3,342,599, 2,507,114, 2,695,234, 3,719,492, U.K. Patent 803,784, Japanese Unexamined Patent Publications Nos. 185628/1978, 79035/1979, and Research Disclosures Nos. 15159, 12146 and 13924.

These aromatic primary amine color developing agents or precursors thereof are required to be added in amounts which can give sufficient color formation in only their amounts when subjected to activation treatment. Such amount depends considerably on the light-sensitive material, but may be approximately between 0.1 and 5 mole, preferably in the range from 0.5 to 3 mole, per 1 mole of silver halide. These color developing agents or precursors thereof can be used either singly or a combination thereof. For incorporating the color developing agent in light-sensitive material, it can be added as a solution dissolved in an appropriate solvent such as water, methanol, ethanol, acetone, etc., or alternatively as an emulsified dispersion by use of a high boiling organic solvent such as dibutyl phthalate, dioctyl phthalate, tricresyl phosphate, etc. Also, it can be added by impregnation in a latex polymer as described in Research Disclosure No. 14850.

The light-sensitive silver halide photographic material after color developing processing is applied with bleaching processing, fixing processing. The bleaching processing may be carried out simultaneously with fixing processing. As the bleaching agent, many compounds may be employed, but among them, polyvalent metal compounds of iron (III), cobalt (III), copper (II), etc., above all complexes of these polyvalent metal cations with organic acids, for example, metal complexes of aminopoly-carboxylic acids such as ethylenediaminetetraacetic acid, nitrilotriacetic acid, N-hydroxyethylethylenediamine-diacetic acid, malonic acid, tartaric acid, malic acid, diglycolic acid, dithioglycolic acid, etc. or ferricyanates, bichromic acid, etc. may be employed singly or in an appropriate combination.

As the fixing agent, a soluble complexing agent which dissolves silver halide as complex may be employed. Examples of such soluble complexing agent may include sodium thiosulfate, ammonium thiosulfate, potassium thiocyanate, thiourea, thioether, etc.

After the fixing processing, ordinarily water washing processing is performed. Alternatively for water washing processing, stabilizing processing may be also practiced, or both may be also used in combination. In the stabilizing liquor to be used in the stabilizing processing, pH controlling agent, chelating agent, antifungal agent, etc. can be contained. As to specific conditions of these, reference can be made to Japanese Unexamined Patent Publication No. 134636/1983, etc.

The silver halide grains contained in the silver halide emulsion according to the present invention may be any of silver chloride, silver chlorobromide, silver bromide, silver iodobromide, silver chloroiodide, or may be also a mixture of these.

The silver halide grains may be those uniform from inner portion of grains to outer portion, or the compositions may be different in inner portion and outer portion of the grains. When the compositions are different in inner portion and outer portion of grains, the composition may be varied either continuously or incontinuously.

The grain size of the silver halide grains to be used in the present invention is not particularly limited, but in view of other photographic performances such as rapid processability and sensitivity, it may be preferably within the range from 0.2 to 1.6 μm, more preferably from 0.25 to 1.2 μm.

The above particle size can be measured by various methods generally employed in the related field of the art. Representative methods are described in Lapland "Analytical Method of Grain Size", A.S.T.M. Symposium on Light Microscopy, 1955, p. 94–122, or in Chapter 2 of "Theory of Photographic Process", co-written by Mieth and James, rd Ed., published by Macmillan (1966).

The particle size can be measured by use of a projected area or an approximate value of diameter of the grain.

When particles have substantially uniform shapes, the grain distribution can be represented considerably accurately as the diameter or projected area.

The distribution of the grain sizes of the silver halide grains according to the present invention may be either poly-dispersed or mono-dispersed, preferably that of a mono-dispersed emulsion.

The silver halide grains to be used in the emulsion of the present invention may be one obtained by any of the acidic method, the neutral method, the ammonia method. Said grains may be either grown continuously or grown after preparation of seed grains.

The method for preparing seed grains and the method for growth may be either the safe or different.

As the system in which the reaction between a soluble silver salt and a soluble halide is carried out may be either one of the normal mixing method, the reverse mixing method, the simultaneous mixing method or a combination of them, etc., but one obtained by the simultaneous mixing method is preferable. Further, as one system of the simultaneous mixing method, it is also possible to use the pAg-controlled double jet method as described in Japanese Unexamined Patent Publication No. 48521/1979.

Further, if necessary, a solvent for silver halide such as thioether, etc. may be also used.

Also, such compounds as mercapto group containing compounds, nitrogen containing heterocyclic compounds or sensitizing dyes may be added during formation of silver halide grains, or after completion of grain formation.

The shape of the silver halide grain according to the present invention may be any desired one. A preferable example is a cubic body having {100) face as the crystal surface. Also, according to the methods described in literatures such as U.S. Pat. Nos. 4,183,756, 4,225,666, Japanese Unexamined Patent Publication No. 26589/1980, Japanese Patent Publication No. 42737/1980, The Journal of Photographic Science (J. Photgr. Sci.), 21, 39 (1973), etc., grains having shapes such as octahetral body, tetradecahedral body, dodecahedral body, etc. can be prepared, and these can be used. Further, grains having twin face may be also used.

The silver halide grains according to the present invention may be grains comprising those of a single shape or a mixture of grains having various shapes.

The silver halide grains to be used in the emulsion of the present invention can add metal ions by use of cadmium salts, zinc salts, lead salts, thallium salts, iridium salts (including complexes), rhodium salts (including complexes), iron salts (including complexes) in the process of forming grains and/or the process of growth thereof to have them included internally of the grains and/or on the surface of grains, and can be also endowed with reducing sensitizing nuclei internally of the grains and/or on the surface of grains by placing in an appropriate reducing atmosphere.

In the present invention, a chemical sensitizer, for example a chalcogen sensitizer can be employed. The chalcogen sensitizer refers comprehensively to sulfur sensitizer, selenium sensitizer, tellurium sensitizer, but for photographic use, sulfur sensitizer, selenium sensitizer are preferred. Further, reducing sensitizing can be also used in combination.

Also, a noble metal compound, such as platinum compound, palladium compound, etc. can be used.

The emulsion of the present invention can be spectrally sensitized to a desired wavelength region by use of dyes known as sensitizing dyes in the field of photography, and said sensitizing dyes may be used either singly or in combination of two or more kinds.

Together with sensitizing dyes, color intensifying sensitizers which are dyes having themselves no spectral sensitizing action, or compounds absorbing substantially no visible light, but intensifying sensitizing action of sensitizing dyes may be also incorporated in the emulsion.

In the emulsion of the present invention, for the purpose of preventing fogging and/or maintaining stably photographic performances during the preparation steps, storage or photographic processing of the light-sensitive material, during chemical sensitization and/or on completion of chemical sensitization, and/or after completion of chemical sensitization, before coating of the silver halide emulsion, compounds known as the antifoggant or stabilizer in the field of photography can be added.

In the present invention, various dye forming substances are employed, and as representative ones, there are dye forming couplers.

As the yellow dye forming coupler, known acylacetamide type couplers can be preferably used. Among these, benzolyacetanilide type and pivaloylacetanilide type compounds are advantageous.

Specific examples of available couplers are those described in U.K. Patents 1,077,874, Japanese Patent Publication No. 40757/1970, Japanese Unexamined Patent Publications Nos. 1031/1972, 26133/1972, 94432/1973, 87650/1975, 3631/1976, 115219/1977, 99433/1979, 133329/1979, 30127/1981, U.S. Pat. Nos. 2,875,057, 3,253,924, 3,265,506, 3,408,194, 3,551,155, 3,551,156, 3,664,841, 3,725,072, 3,730,722, 3,891,445, 3,900,483, 3,929,484, 3,933,500, 3,973,968, 3,990,896, 4,012,259, 4,022,620, 4,029,508, 4,057,432, 4,106,942, 4,133,958, 4,269,936, 4,286,053, 4,304,845, 4,314,023, 4,336,327, 4,356,258, 4,386,155, 4,401,752, etc.

The diffusion resistant yellow coupler to be used in the light-sensitive material is represented preferably by the following formula [Y]:

Formula [Y]

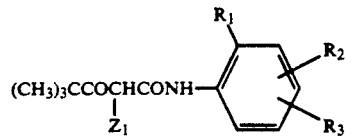

In the formula, $R_1$ represents a halogen atom or an alkoxy group. $R_2$ represents hydrogen atom, a halogen atom or an alkoxy group which may also have substituent. $R_3$ represents an acylamino group, an alkoxycarbonyl group, an alkylsulfamoyl group, an arylsulfamoyl group, an arylsulfonamide group, an alkylureido group, an arylureido group, a succinimide group, an alkoxy group or an aryloxy group which may also have substituent.

$Z_1$ represents an eliminable group when coupling with the oxidized product of a color developing agent.

In the present invention, as the magenta dye image forming coupler, the couplers represented by the following formulae [M-I] and [M-II] can be preferably used.

Formula [M-I]

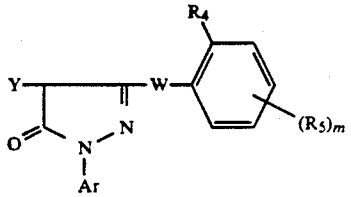

In the formula, Ar represents an aryl group, $R_4$ represents hydrogen atom or a substituent, $R_5$ represents a substituent. Y represents hydrogen atom or a substituent eliminable through the reaction with the oxidized product of a color developing agent, W represents —NH—, —NHCO—(N atom is bonded to the carbon atom of pyrazolone nucleus) or —NHCONH—, and m is an integer of 1 or 2.

Formula [M-II]

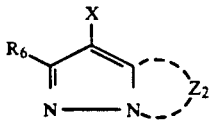

In the formula, $Z_2$ represents a group of non-metal atoms necessary for forming a nitrogen containing heterocyclic ring, and the ring formed by said $Z_2$ may also have substituent.

X represents hydrogen atom or a substituent eliminable through the reaction with the oxidized product of a color developing agent.

$R_6$ represents hydrogen atom or a substituent. Examples of the substituent represented by the above $R_6$ may include halogen atoms, alkyl, cycloalkyl, alkenyl, cycloalkenyl, alkynyl, aryl, heterocyclic, acyl, sulfonyl, sulfinyl, phosphonyl, carbamoyl, sulfamoyl, cyano, spiro compound residual, organic hydrocarbon compound residual, alkoxy, aryloxy, heterocyclicoxy, siloxy, acyloxy, carbamoyloxy, amino, acylamino, sulfonamide, imide, ureido, sulfamoylamino, alkoxy-carbonylamino, aryloxycarbonylamino, alkoxycarbonyl, aryloxycarbonyl, alkylthio, arylthio and heterocyclicthio groups.

As the cyan dye image forming coupler, phenol type, naphthol type tetravalent or divalent type cyan couples are representative, but the couplers represented by the following formulae [C-I], [C-II] can be preferably used.

Formula [C-I]

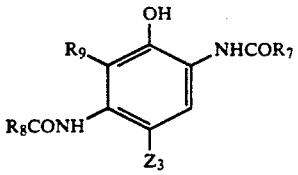

In the formula, $R_7$ represents an aryl, cycloalkyl or heterocyclic group. $R_8$ represents an alkyl or phenyl group. $R_9$ represents hydrogen atom, a halogen atom, an alkyl or alkoxy group.

$Z_3$ represents hydrogen atom, a halogen atom or a group eliminable through the reaction with the oxidized product of an aromatic primary amine type color developing agent.

Formula [C-II]

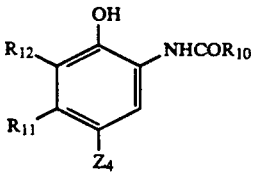

In the formula, $R_{10}$ represents an alkyl group (e.g. methyl, ethyl, propyl, butyl, nonyl). $R_{11}$ represents an alkyl group (e.g. methyl, ethyl). $R_{12}$ represents hydrogen atom, a halogen atom (e.g. fluorine, chlorine, bromine) or an alkyl group (e.g. methyl, ethyl).

$Z_4$ represents hydrogen atom, a halogen atom or a group eliminable through the reaction with the oxidized product of an aromatic primary amine type color developing agent.

In the light-sensitive silver halide photographic material to be used in the present invention, various known additives for photography can be contained. Examples of such additive may include UV-ray absorbers (e.g. benzophenone type compounds and benzotriazole type compounds), dye image stabilizers (e.g. phenol type compounds, bisphenol type compound, hydroxycouromane type compounds, spirobicouromane type compounds, hydantoin type compounds and dialkoxybenzene type compounds), antistaining agents (e.g. hydroquinone derivatives), surfactants (e.g. sodium alkylnaphthalene sulfonate, sodium alkylbenzene sulfonate, sodium alkylsuccinate sulfonate, polyalkylene glycol), water soluble irradiation preventive dyes (e.g. azo type compounds, styryl type compounds, triphenylmethane type compounds, oxonol type compounds and anthraquinone type compounds), film hardeners (e.g. halogeno-s-triazine type compounds, vinylsulfone type compounds, acryloyl type compounds, ethyleneimine type compounds, N-methylol type compounds, epoxy type compounds and water soluble aluminum salts), film property improvers (e.g. glycerine, aliphatic polyvalent alcohols, polymer dispersions (latices), solid or liquid paraffins and colloidal silica), fluorescent brighteners (compounds outside of the present invention) and various oil-soluble coating materials, etc.

When the total amount of the hydrophobic oily components to be included in the present invention, for example, a high boiling solvent and a dye forming coupler, an image stabilizer, an antistaining agent, etc. is small, the effect of the present invention becomes more conspicuous, and therefore it should be preferably 0.5 g/m$^2$ or less.

As the photographic layer constituting the light-sensitive silver halide photographic material of the present invention, in addition to various emulsion layers, various layers such as subbing layer, intermediate layer, yellow color filter layer, Uv-ray absorbing layer, protective layer, halation preventive layer, etc. can be suitably provided as desired.

As the support of the light-sensitive silver halide photographic material of the present invention, there can be employed suitably supports such as paper, glass, cellulose acetate, cellulose nitrate, polyester, polyamide polystyrene, etc., or plastered products of two or more kinds of substrates such as laminates of paper and polyolefin (e.g. polyethylene and polypropylene), etc. depending on the purpose.

Such support may be generally subjected to various surface treatments for improvement of adhesion to the silver halide emulsion layer, such as surface roughening mechanically or with an appropriate organic solvent, electron impact treatment, or surface treatment such as flame treatment, etc., or one applied with subbing treatment to provide a subbing layer may be also employed.

The present invention is described in detail below by way of Examples, but the embodiments of the present invention are not limited by these at all.

EXAMPLE-1

On a polyethylene resin coated paper, 7 layers shown below in Table-1 were provided by coating to prepare a multi-layer light-sensitive silver halide photographic material.

TABLE 1

| Layer | Constitution | Amount added (g/m$^2$) |
|---|---|---|
| 1st layer (Blue-sensititve layer) | Gelatin | 1.40 |
| | Blue-sensitive silver chlorobromide emulsion (silver bromide content: 80 mole %) | 0.30* |
| | Yellow coupler (Y-1) | 0.77 |
| | Dye image stabilizer (ST-1) | 0.30 |
| | Antistain agent (HQ-1) | 0.02 |
| | DNP | 0.30 |
| 2nd layer | Gelatin | 1.40 |
| | Antistain agent (HQ-2) | 0.075 |
| | Fluorescent brightener (F-1) | 0.21 |

TABLE 1-continued

| Layer | Constitution | Amount added (g/m$^2$) |
|---|---|---|
| | DIDP | 0.13 |
| 3rd layer (Green-sensitive layer) | Gelatin | 1.3 |
| | Green-sensitive silver chlorobromide emulsion (Silver bromide content: 60 mole %) | 0.28* |
| | Magenta coupler (M-1) | 0.35 |
| | Dye image stabilizer (ST-2) | 0.23 |
| | DIDP | 0.28 |
| | Dye (D-1) | 0.005 |
| 4th layer (UV-ray absorbing layer) | Gelatin | 1.2 |
| | UV-ray absorber (UV-1) | 0.20 |
| | UV-ray absorber (UV-2) | 0.50 |
| | Antistain agent (HQ-1) | 0.003 |
| | CA-1 | 0.007 |
| | DNP | 0.60 |
| 5th layer (Red-sensitive layer) | Gelatin | 1.4 |
| | Red-sensitive silver chlorobromide emulsion (silver bromide content: 60 mole %) | 0.21* |
| | Cyan coupler (C-1) | 0.13 |
| | Cyan coupler (C-2) | 0.26 |
| | Dye image stabilizer (ST-1) | 0.22 |
| | DOP | 0.25 |
| | Antistain agent (HQ-1) | 0.01 |
| 6th layer (UV-ray absorbing layer) | Gelatin | 0.6 |
| | UV-ray absorber (UV-1) | 0.10 |
| | UV-ray absorber (UV-2) | 0.25 |
| | Antistain agent (HQ-1) | 0.01 |
| | Dye (D-2) | 0.02 |
| | Dye (D-3) | 0.01 |
| | DNP | 0.3 |
| 7th layer | Gelatin | 1.2 |
| | DIDP | 0.02 |

(*calculated on metallic silver)

As the surfactant for dispersion and coating, S-1 was employed.

As the film hardener, 5 mg of H-1 was added per 1 g of gelatin, and 10 mg of H-2 per 1 g of gelatin.

As described above, a multi-layer light-sensitive silver halide color material sample 1 was prepared.

Next, samples 2 to 11 were prepared in the same manner as in sample 1 except for changing the gelatin amount coated in the second, fourth, sixth, seventh layer and the amount added and the kind of the brightener in the second layer as shown in Table-2.

Further, sample 12 was prepared in the same manner as in sample 5 except for changing the fourth and sixth layers as shown in Table-3.

TABLE 3

| Layer | Constitution | Amount added (g/m$^2$) |
|---|---|---|
| 4th layer (UV-ray absorbing layer) | Gelatin | 0.85 |
| | UV-ray absorber (UV-2) | 0.25 |
| | UV-ray absorber (UV-3) | 0.45 |
| | Antistain agent (HQ-1) | 0.03 |
| 6th layer (UV-ray absorbing layer) | Gelatin | 0.35 |
| | UV-ray absorber (UV-2) | 0.1 |
| | UV-ray absorber (UV-3) | 0.20 |
| | Antistain agent (HQ-1) | 0.01 |

Y-1

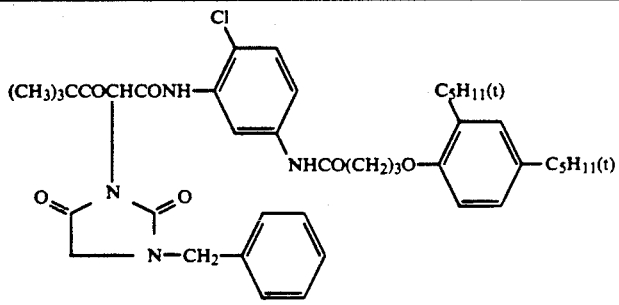

TABLE 3-continued
| Layer | Constitution | Amount added (g/m²) |
|---|---|---|
| | 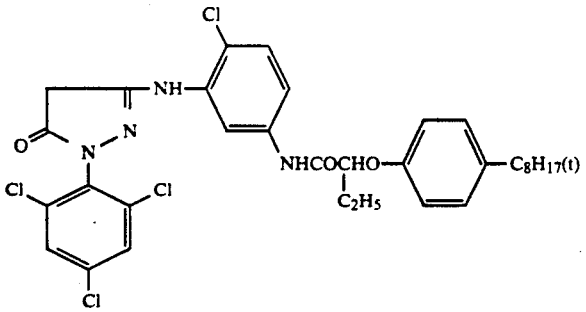 M-1 | |
| | 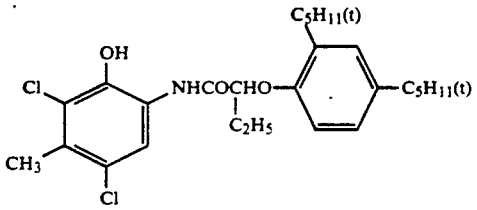 C-1 | |
| | 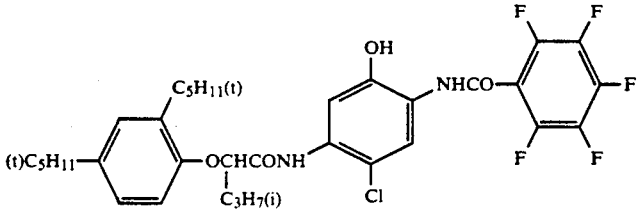 C-2 | |
| | 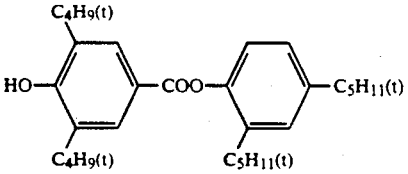 ST-1 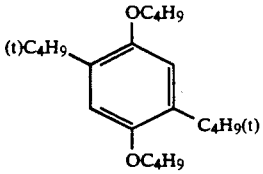 ST-2 | |
| | 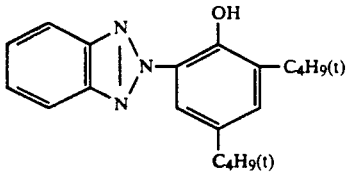 UV-1 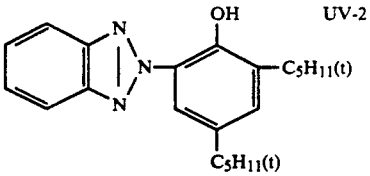 UV-2 | |
| | 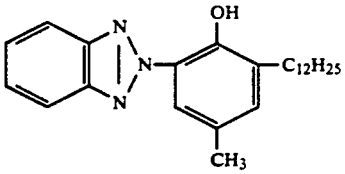 UV-3 | DOP (dioctyl phthalate)<br>DNP (dinonyl phthalate)<br>DIDP (diisodecyl phthalate)) |
| | 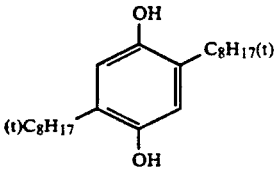 HQ-1 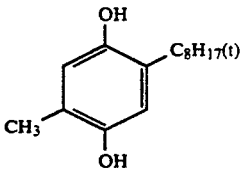 HQ-2 | |

TABLE 3-continued

| Layer | Constitution | Amount added (g/m²) |
|---|---|---|
| | 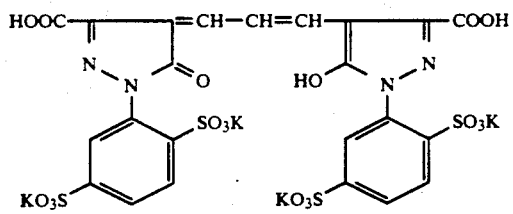 | D-1 |
| | 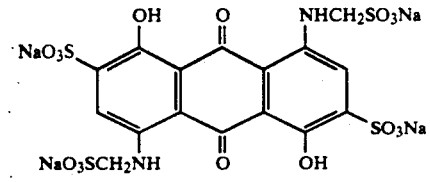 | D-2 |
| | 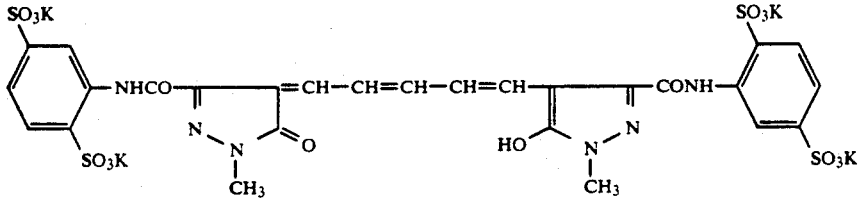 | D-3 |
| | 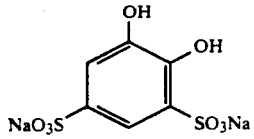 CA-1 | 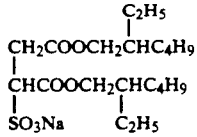 S-1 |
| | 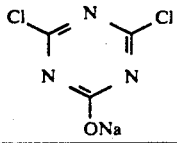 H-1 | $C(CH_2SO_2CH{=}CH_2)_4$ H-2 |

After exposure of each sample by use of a photosensitometer Model KS-7 (Konika Corporation), continuous processing was practiced following the development processing step-A shown below.

After completion of processing, sensitometry was performed by Model PDS-65 densitometer (Konika Kabushiki Kaisha).

| [Color developing processing step-A] | | |
|---|---|---|
| [1] Color developing | 39.5° C. | 3 min. 30 sec. |
| [2] Bleach-fixing | 39.5° C. | 1 min. 30 sec. |
| [3] Stabilizing | 25° C.-30° C. | 3 min. |
| [4] Drying | 75° C.-80° C. | 2 min. (about) |

The amount of the color developing solution replenished was made 61 ml/m²-sensitive material.

| [Processing liquor compositions] | Tank solution | Replenished solution |
|---|---|---|
| Color developing solution | | |
| Benzyl alcohol | 15 ml | 38 ml |
| Diethylene glycol | 10 g | 23 g |
| Diethylenetriaminepenta-acetic acid | 3 g | 7 g |
| Potassium sulfite | 2.0 g | 4 g |
| Potassium bromide | 3.5 g | — |

-continued

| [Processing liquor compositions] | Tank solution | Replenished solution |
|---|---|---|
| Sodium chloride | 0.2 g | — |
| Potassium carbonate | 30 g | 30 g |
| Hydroxylamine sulfate | 3 g | 6 g |
| Polyphosphoric acid (TPPS) | 2.5 g | 5 g |
| Triethanolamine | 10 g | 12 g |
| 3-Methyl-4-amino-N-ethyl-N-β-methanesulfonamido-ethylaniline sulfate | 5.5 g | 14 g |
| Fluorescent brightener (4,4'-diaminostilbene disulfonic acid derivative) | 1.0 g | 2.5 g |
| pH | 10.3 | 10.9 |
| made up to total amount of one liter with addition of water) | | |
| Bleach-fixing solution | | |
| Ferric ammonium ethylenediaminetetra-acetate dihydrate | | 60 g |
| Ammoniumthiosulfate ethylenediamine-tetraacetate (70% aqueous solution) | | 100 ml |
| Ammonium sulfite (40% aqueous solution) | | 27.5 ml |
| (made up to total amount of one liter with addition of water, and adjusted to pH = 7.1 with potassium carbonate or glacial acetic acid) | | |
| Stabilizing solution | | |
| 5-Chloro-2-methyl-4-isothiazolin-3-one | | 1.0 g |
| Ethylene glycol | | 1.0 g |
| 1-Hydroxyethylidene-1,1-diphosphonic acid | | 2.0 g |
| Ethylenediaminetetraacetic acid | | 1.0 g |

-continued

| [Processing liquor compositions] | Tank solution | Replenished solution |
|---|---|---|
| Ammonium hydroxide (20% aqueous solution) | 3.0 g | |
| Ammonium sulfite | 3.0 g | |
| Fluorescent brightener (4,4'-diaminostilbenedisulfonic acid derivative) | 1.5 g | |
| (made up to total amount of one liter with addition of water, and adjusted to pH = 7.0 with sulfuric acid or potassium hydroxide) | | |

Evaluation of developability

When the sensitivity at the standard developing time (3 min. 30 sec.) of the blue-sensitive layer which is the silver halide emulsion layer nearest to the support is made 100, the difference between the sensitivity at the standard developing time and the relative sensitivity at the developing time 2 min. 30 sec. is defined as $\Delta S^B$. Greater $\Delta S^B$ indicates greater sensitivity fluctuation, meaning that developability is inferior, namely that processing stability is poor.

Evaluation of white ground

The spectrally reflected spectrum of the unexposed portion was measured by Hitachi Color Analyzer Model 607, and the reflective densities at 440 nm, 510 nm, 650 nm, namely $D_{440}$, $D_{510}$, $D_{650}$ were made the measure for white ground.

TABLE 2

| Sample No. | Gelatin amount (g/m²) in 2nd layer | in 4th layer | in 6th layer | in 7th layer | Total gelatin | Brightener Added layer | Kind | Total hydrophobic oily material amount (g/m²) | Developability ($\Delta S^B$) | White ground $D_{440}$ | $D_{510}$ | $D_{650}$ | Desilverizability* |
|---|---|---|---|---|---|---|---|---|---|---|---|---|---|
| 1 | 1.4 | 1.2 | 0.6 | 1.2 | 8.5 | 2nd layer | F-1 | 5.4 | 31 | 0.104 | 0.114 | 0.107 | Δ~X |
| 2 | 1.4 | 1.2 | 0.6 | 1.2 | 8.5 | — | — | 5.4 | 28 | 0.112 | 0.120 | 0.107 | ○ |
| 3 | 1.2 | 1.1 | 0.5 | 1.0 | 7.9 | 2nd layer | F-1 | 5.4 | 23 | 0.100 | 0.111 | 0.105 | ○~Δ |
| 4 | 1.2 | 1.1 | 0.5 | 1.0 | 7.9 | — | — | 5.4 | 21 | 0.108 | 0.120 | 0.106 | ○ |
| 5 | 1.0 | 0.8 | 0.4 | 0.9 | 7.2 | 2nd layer | F-1 | 5.4 | 10 | 0.091 | 0.099 | 0.103 | ○ |
| 6 | 1.0 | 0.8 | 0.4 | 0.9 | 7.2 | — | — | 5.4 | 9 | 0.103 | 0.117 | 0.104 | ○ |
| 7 | 1.0 | 0.8 | 0.4 | 0.9 | 7.2 | 2nd layer | F-2 | 5.4 | 8 | 0.092 | 0.101 | 0.103 | ○ |
| 8 | 1.0 | 0.8 | 0.4 | 0.9 | 7.2 | 2nd layer | F-3 | 5.4 | 10 | 0.090 | 0.100 | 0.104 | ○ |
| 9 | 1.0 | 0.8 | 0.4 | 0.9 | 7.2 | 2nd layer | F-7 | 5.4 | 9 | 0.094 | 0.102 | 0.104 | ○ |
| 10 | 1.0 | 0.8 | 0.4 | 0.9 | 7.2 | 1st layer (⅓) 2nd layer (⅓) 3rd layer (⅓) | F-1 | 5.4 | 8 | 0.095 | 0.100 | 0.104 | ○ |
| 11 | 1.0 | 0.8 | 0.4 | 0.9 | 7.2 | 1st layer (⅘) 5th layer (⅕) | F-1 | 5.4 | 9 | 0.093 | 0.102 | 0.104 | ○ |
| 12 | 1.0 | 0.8 | 0.4 | 0.9 | 7.2 | 2nd layer | F-1 | 4.4 | 5 | 0.086 | 0.093 | 0.100 | ○ |

*desilverizability
○: no residual silver
Δ: residual silver slightly present
X: residual silver present From Table-2, the following facts could be seen.

(1) In samples 2, 4 containing large amount of gelatin and having no brightener of the present invention, $\Delta S^B$ is greater, namely inferior in developability, and also white ground is poor.

(2) Even when the gelatin amount may be reduced to within the range of the present invention, if no brightener is contained (sample 6), although improvement of developability can be recognized, improvement of white ground is insufficient.

(3) When a brightener is contained, although considerable effect of improvement of white ground can be seen, if gelatin is much, the brightener affects adversely desilverizability (samples 1, 3).

(4) When the gelatin amount is reduced to within the range of the present invention, and a brightener is contained, improvement of developability and still better brightening effect can be obtained, and further there is also no deterioration of desilverizability (samples 5, 7–9).

(5) The layer into which the brightener is added is not particularly limited (samples 10, 11).

(6) By reduction in amount of the hydrophobic oily material contained, the effect of the present invention becomes further conspicuous (sample 12).

EXAMPLE-2

Similarly as in Example 1, a multi-layer light-sensitive silver halide photographic material was prepared (sample 13).

TABLE 4

| Layer | Constitution | Amount added (g/m²) |
|---|---|---|
| 7th layer (Protective layer) | Gelatin | 1.0 |
| 6th layer (UV-ray absorbing layer) | Gelatin | 0.6 |
| | UV-ray absorber (UV-1) | 0.2 |
| | UV-ray absorber (UV-2) | 0.2 |
| | Antistain agent (HQ-1) | 0.01 |
| | DNP | 0.2 |
| | Anti-irradiation dye (AI-3) | 0.02 |
| 5th layer (Red-sensitive layer) | Gelatin | 1.40 |
| | Red-sensitive silver chlorobromide emulsion (Emc) (in terms of silver) | 0.24 |
| | Cyan coupler (C-3) | 0.17 |
| | Cyan coupler (C-2) | 0.25 |
| | Dye image stabilizer (ST-1) | 0.20 |
| | Antistain agent (HQ-1) | 0.01 |
| | HBS-1 | 0.20 |
| | DOP | 0.30 |
| 4th layer (UV-ray absorbing layer) | Gelatin | 1.30 |
| | UV-ray absorber (UV-1) | 0.40 |
| | UV-ray absorber (UV-2) | 0.40 |
| | Antistain agent (HQ-1) | 0.03 |

TABLE 4-continued

| Layer | Constitution | Amount added ($g/m^2$) |
|---|---|---|
| | DNP | 0.40 |
| 3rd layer (Green-sensitive layer) | Gelatin | 1.30 |
| | Green-sensitive silver chlorobromide emulsion (EmB) (in terms of silver) | 0.17 |
| | Magenta coupler (M-2) | 0.35 |
| | Dye image stabilizer (ST-3) | 0.15 |
| | Dye image stabilizer (ST-4) | 0.15 |
| | DNP | 0.20 |
| | Anti-irradiation dye (D-1) | 0.01 |
| 2nd layer (Intermediate layer) | Gelatin | 1.30 |
| | Antistain agent (HQ-1) | 0.12 |
| | DIDP | 0.15 |
| 1st layer (Blue-sensitive layer) | Gelatin | 1.20 |
| | Blue-sensitive silver chlorobromide emulsion (EmA) (in terms of silver) | 0.30 |
| | Yellow coupler (Y-2) | 0.80 |
| | Dye image stabilizer (ST-1) | 0.30 |
| | Dye image stabilizer (ST-5) | 0.20 |
| | Antistain agent (HQ-1) | 0.02 |
| | Anti-irradiation dye (D-4) | 0.01 |
| | DNP | 0.20 |
| Support | Polyethylene-laminated paper | |

Next, a sample 14 was prepared similarly as the sample 13 except for addition of 0.2 $g/m^2$ of F-1 in the second layer of the sample 13.

Further, samples 15, 16 were prepared similarly as samples 13, 14 except for changing the gelatin in the second layer to 1.0 $g/m^2$, the gelatin in the 4th layer to 0.9 $g/m^2$, the gelatin in the 6th layer to 0.45 $g/m^2$, the gelatin in the 7th layer to 0.85 $g/m^2$, respectively, in samples 13, 14.

Y-2

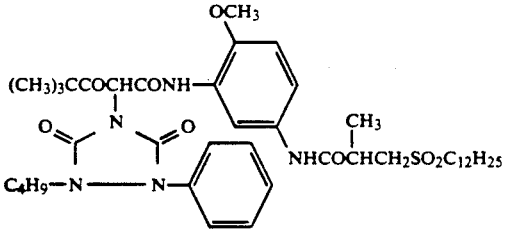

M-2

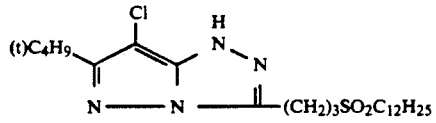

C-3

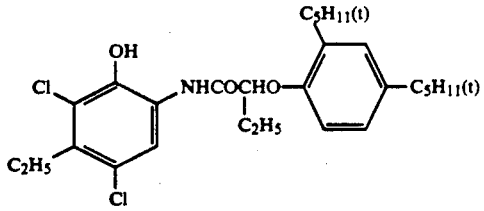

ST-3

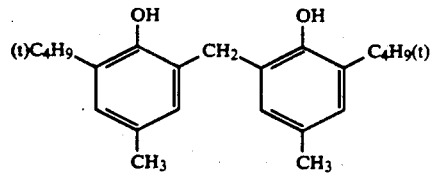

-continued

ST-4

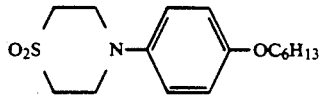

ST-5

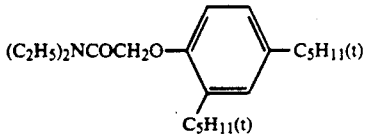

D-4

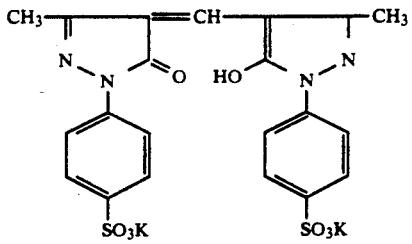

HBS-1

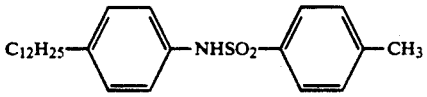

As the film hardener, H-1 was employed.

Preparation method of blue-sensitive silver halide emulsion

Into 1000 ml of an aqueous 2% gelatin solution maintained at 40° C., (Solution A) and (Solution B) shown below were added at the same time over 30 minutes under control of pAg=6.5, pH=3.0, and further (Solution C) and (Solution D) were added at the same time over 180 minutes under control of pAg=7.3 pH=5.5.

At this time, pAg was controlled according to the method described in Japanese Unexamined Patent Publication No. 45437/1984, and pH controlled with addition of an aqueous solution of sulfuric acid or sodium hydroxide.

| | |
|---|---|
| (Solution A) | |
| Sodium chloride | 3.42 g |
| Potassium bromide | 0.03 g |
| Water added to | 200 ml |
| (Solution B) | |
| Silver nitrate | 10 g |
| Water added to | 200 ml |
| (Solution C) | |
| Sodium chloride | 102.7 g |
| Potassium bromide | 1.0 g |
| Water added to | 600 ml |
| (Solution D) | |
| Silver nitrate | 300 g |
| Water added to | 600 ml |

After completion of addition, the mixture was desalted with the use of a 5% aqueous solution of Demol N manufactured by Kao-Atlas and a 20% aqueous solution of magnesium sulfate, followed by mixing with an aqueous gelatin solution to obtain a mono-dispersed cubic emulsion EMP-1 with an average grain size of 0.85 μm, a coefficient of fluctuation of 0.07 and a silver chloride content of 99.5 mole %.

The above emulsion EMP-1 was subjected to chemical aging by use of the compounds shown below at 50°

C. for 90 minutes to obtain a blue-sensitive silver halide emulsion (EmA).

| | |
|---|---|
| Sodium thiosulfate | 0.8 mg/mole AgX |
| Chloroauric acid | 0.5 mg/mole AgX |
| Stabilizer SB-5 | $6 \times 10^{-4}$ mole/mole AgX |
| Sensitizing dye D-1 | $5 \times 10^{-4}$ mole/mole AgX |

Preparation method of green-sensitive silver halide emulsion

Except for changing the addition timings of (Solution A) and (Solution B) and the addition timings of (Solution C) and (Solution D), in the same manner as in EMP-1, a monodispersed cubic emulsion EMP-2 was obtained, having an average grain size of 0.43 μm, a coefficient of fluctuation of 0.08 and containing 99.5 mole % of silver halide.

The EMP-2 was subjected to chemical aging with the use of the compounds shown below at 55° C. for 120 minutes to obtain a green-sensitive silver halide emulsion (EmB).

| | |
|---|---|
| Sodium thiosulfate | 1.5 mg/mole AgX |
| Chloroauric acid | 1.0 mg/mole AgX |
| Stabilizer SB-5 | $6 \times 10^{-4}$ mole/mole AgX |
| Sensitizing dye D-2 | $4 \times 10^{-4}$ mole/mole AgX |

Preparation method of red-sensitive silver halide emulsion

Except for changing the addition timings of (Solution A) and (Solution B) and the addition timings of (Solution C) and (Solution D), in the same manner as in EMP-1, a monodispersed cubic emulsion EMP-3 was obtained, having an average grain size of 0.50 μm, a coefficient of fluctuation of 0.08 and containing 99.5 mole % of silver halide.

The EMP-3 was subjected to chemical aging with the use of the compounds shown below at 60° C. for 90 minutes to obtain a red-sensitive silver halide emulsion (EmC).

| | |
|---|---|
| Sodium thiosulfate | 1.8 mg/mole AgX |
| Chloroauric acid | 2.0 mg/mole AgX |
| Stabilizer SB-5 | $6 \times 10^{-4}$ mole/mole AgX |
| Sensitizing dye D-3 | $8 \times 10^{-4}$ mole/mole AgX |

D-1

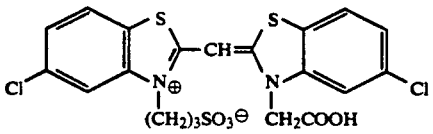

D-2

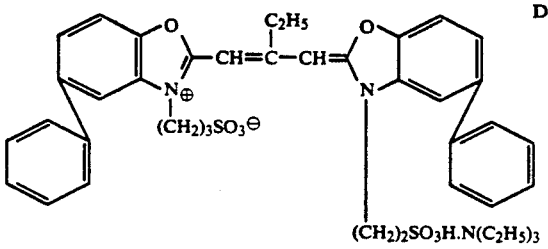

-continued

D-3

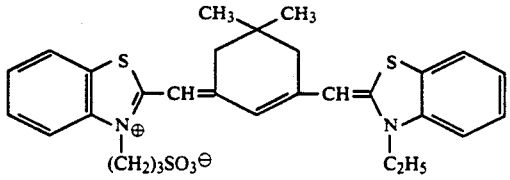

SB-5

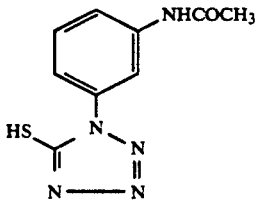

p These samples were exposed according to the method as described in Example-1 and then subjected to continuous treatment following the processing steps shown below.

| Processing step | Temperature | Time |
|---|---|---|
| Color developing | 38.0 ± 0.3° C. | 30 sec. |
| Bleach-fixing | 38.0 ± 0.5° C. | 45 sec. |
| Stabilizing | 30–34° C. | 90 sec. |
| Drying | 60–80° C. | 60 sec. |

The amount of the color developing solution replenished was made 61 ml/m²-sensitive material.

| | Tank solution | Replenished solution |
|---|---|---|
| Color developing solution | | |
| Pure water | 800 ml | 800 ml |
| Triethanolamine | 10 g | 12 g |
| N,N-diethylhydroxylamine | 5 g | 12.5 g |
| Potassium bromide | 0.02 g | — |
| Potassium chloride | 2 g | — |
| Potassium sulfite | 0.3 g | 0.7 g |
| 1-Hydroxyethylidene-1,1-diphosphonic acid | 1.0 g | 0.3 g |
| Ethylenediaminetetraacetic acid | 1.0 g | 1.0 g |
| Catechol-3,5-disulfonic acid disodium salt | 1.0 g | 1.0 g |
| N-ethyl-N-β-methanesulfonamidoethyl-3-methyl-4-aminoaniline sulfate | 5.5 g | 14 g |
| Fluorescent brightener (4,4'-diaminostilbene disulfonic acid derivative) | 1.0 g | 2.5 g |
| Potassium carbonate | 27 g | 27 g |
| (made up to total amount of one liter with addition of water) | | |
| pH | 10.20 | 10.9 |
| Bleach-fixing solution | | |
| Ferric ammonium ethylenediaminetetraacetate dihydrate | 60 g | |
| Ethylenediaminetetraacetic acid | 3 g | |
| Ammonium thiosulfate (70% aqueous solution) | 100 ml | |
| Ammonium sulfite (40% aqueous solution) | 27.5 ml | |
| (made up to total amount of one liter with addition of water, and adjusted to pH = 5.7 with potassium carbonate or glacial acetic acid) | | |
| Stabilizing solution | | |
| 5-Chloro-2-methyl-4-isothiazolin-3-one | 1.0 g | |
| Ethylene glycol | 1.0 g | |
| 1-Hydroxyethylidene-1,1-diphosphonic acid | 2.0 g | |
| Ethylenediaminetetraaetic acid | 1.0 g | |
| Ammonium hydroxide (20% aqueous solution) | 3.0 g | |

-continued

| | |
|---|---|
| Fluorescent brightener (4,4'-diaminostilbenedisulfonic acid derivative) | 1.5 g |

(4,4'-diaminostilbenedisulfonic acid derivative) (made up to total amount of one liter with addition of water, and adjusted to pH = 7.0 with sulfuric acid or potassium hydroxide)

For the processed samples, the same evaluations as in Example-1 were conducted.

However, developability was evaluated by the relative sensitivity difference of the blue-sensitive layer between the developing time of 20 seconds and 30 seconds.

The results are shown in Table-5.

TABLE 5

| Sample No. | Gelatin amount ($g/m^2$) in 2nd layer | in 4th layer | in 6th layer | in 7th layer | Total gelatin | Brightener Added layer | Kind | Developability ($\Delta S^B$) | White ground $D_{440}$ | $D_{510}$ | $D_{650}$ | Desilverizability* |
|---|---|---|---|---|---|---|---|---|---|---|---|---|
| 13 | 1.3 | 1.3 | 0.6 | 1.0 | 8.1 | — | — | 33 | 0.114 | 0.125 | 0.106 | Δ~X |
| 14 | 1.3 | 1.3 | 0.6 | 1.0 | 8.1 | 2nd layer | F-3 | 31 | 0.102 | 0.117 | 0.105 | Δ |
| 15 | 1.0 | 0.9 | 0.45 | 0.85 | 7.1 | — | — | 13 | 0.104 | 0.122 | 0.106 | ○ |
| 16 | 1.0 | 0.9 | 0.45 | 0.85 | 7.1 | 2nd layer | F-3 | 13 | 0.090 | 0.110 | 0.104 | ○ |

*desilverizability

Δ: residual silver slightly present

○: no residual silver

X: residual silver present

From Table-5, it can be seen that the effect of the present invention can be exhibited even in rapid processing.

We claim:

1. A method for processing a light-sensitive silver halide photographic material having at least one silver halide emulsion layer on a reflective support, comprising the step of processing at least one layer of said silver halide emulsion layer containing a compound represented by formula (I) shown below, and said light-sensitive silver halide photographic material with a total amount of hydrophilic binder of 7.5 $g/m^2$ or less with a color developer, and replenishing with an amount of the color developer of 25 to 100 ml per 1 $m^2$ of said light-sensitive silver halide photographic material:

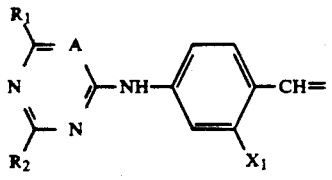

Formula (I)

-continued

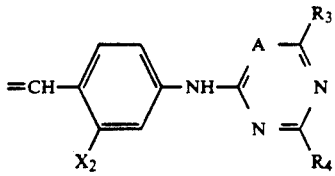

wherein A represents

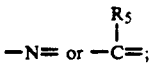

$R_1$, $R_2$, $R_3$ and $R_4$, which may be the same or different, each represent a substituted or unsubstituted alkyl group, a substituted or unsubstituted alkylamino group, a substituted or unsubstituted arylamino group or a substituted or unsubstituted aryloxy group; $R_5$ represents a substituent; $X_1$ and $X_2$ each represent a hydrogen atom or $—SO_3M$ group, M represents a hydrogen atom or an atom or a group of atoms forming a water-soluble salt; the sum of $—SO_3M$ groups in the compound is 1 to 6.

2. The method for processing a light-sensitive silver halide photographic material according to claim 1, wherein $R_1$, $R_2$, $R_3$ and $R_4$ each represent at least one selected from the group consisting of 2-ethylaminoethyl, ethyl, N,N-diethylamino, N,N-di-2-hydroxyethylamino, phenylamino and phenoxy; $R_5$ is a group which can be substituted on pyrimidine ring; and the group of atoms forming a water soluble salt is at least one of $—NH_4$ and alkali metal.

3. The method for processing a light-sensitive silver halide photographic material according to claim 1, wherein the compound represented by the formula (I) is at least one selected from the group consisting of (1)

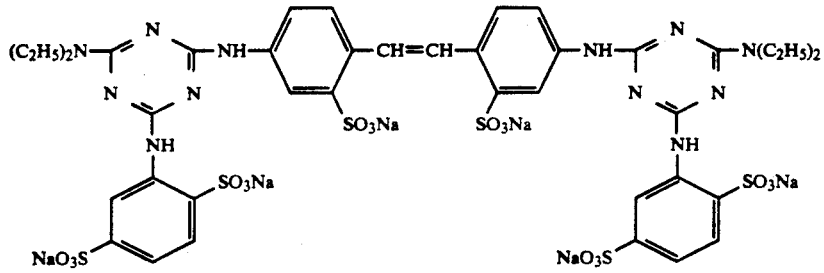

-continued (2)

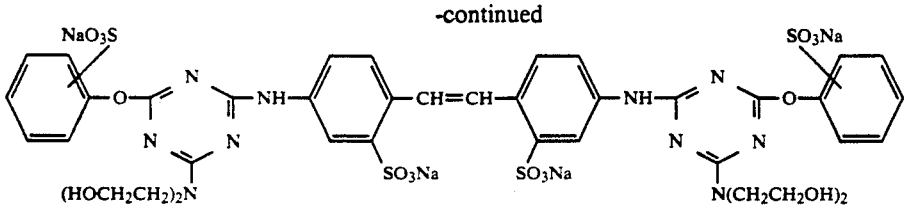

(3)

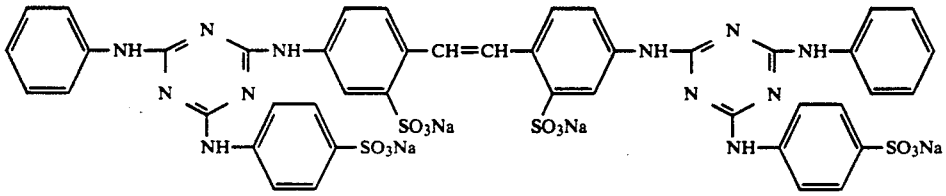

(4)

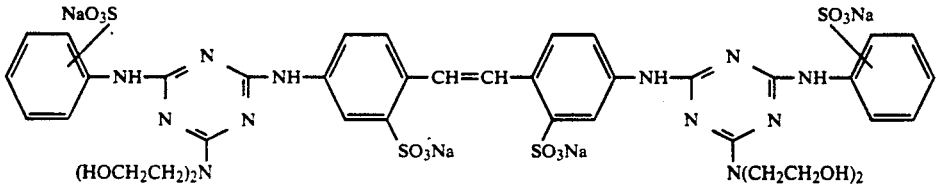

(5)

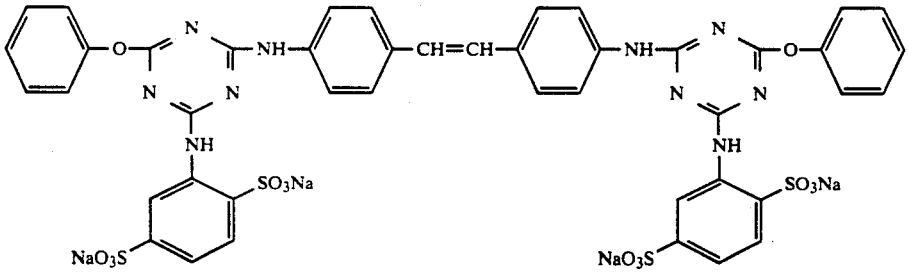

(6)

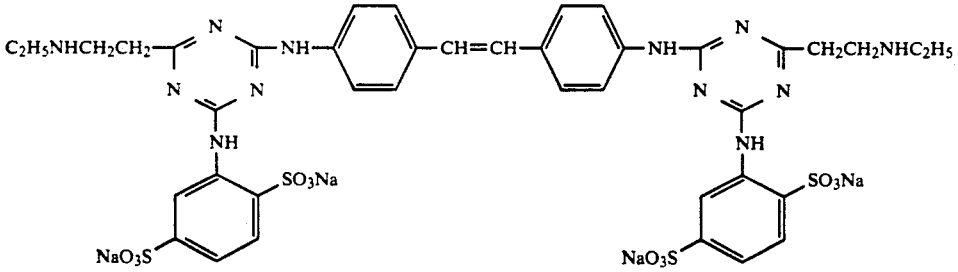

(7)

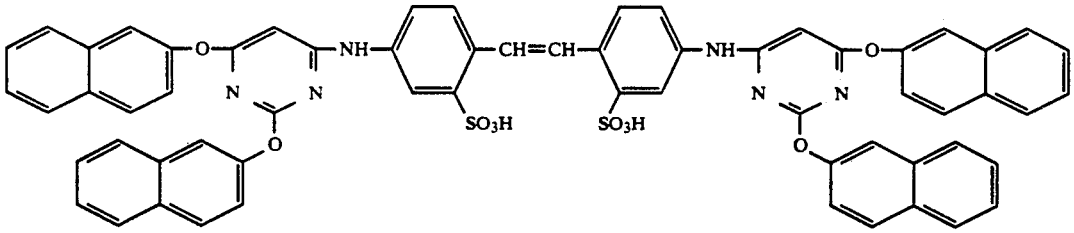

4. The method for processing a light-sensitive silver halide photographic material according to claim 1, wherein the added amount of the compound of the formula (I) is 0.01 to 3.0 mg/dm$^2$.

5. The method for processing a light-sensitive silver halide photographic material according to claim 1, wherein the added amount of the compound of the formula (I) is 0.1 to 2.0 mg/dm$^2$.

6. The method for processing a light-sensitive silver halide photographic material according to claim 1, wherein the compound of the formula (I) is contained in a non-emulsion layer of constituent layers of the light-sensitive silver halide photographic material.

7. The method for processing a light-sensitive silver halide photographic material according to claim 1, wherein silver halide grains of the silver halide emulsion layer is at least one selected from the group consisting of silver chloride, silver chlorobromide, silver bromide, silver iodobromide and silver chloroiodide grains and a mixture thereof.

8. The method for processing a light-sensitive silver halide photographic material according to claim 1, wherein the grain size of the silver halide grains is 0.2 to 1.6 μm.

9. The method for processing a light-sensitive silver halide photographic material according to claim 8, wherein the grain size of the silver halide grains is 0.25 to 1.2 μm.

10. The method for processing a light-sensitive silver halide photographic material according to claim 1, wherein the hydrophilic binder is at least one selected from the group consisting of gelatin, gelatin derivatives, graft polymers of gelatin with other polymers, other proteins, sugar derivatives, cellulose derivatives, synthetic hydrophilic polymeric substances.

11. The method for processing a light-sensitive silver halide photographic material according to claim 10, wherein the hydrophilic binder is gelatin.

12. The method for processing a light-sensitive silver halide photographic material according to claim 1, wherein the color developer contains a color developing agent in an amount of about 1 to 30 g per 1 liter of the color developer.

13. The method for processing a light-sensitive silver halide photographic material according to claim 12, wherein the color developer contains a color developing agent in an amount of about 1 to 15 g per 1 liter of the color developer.

14. The method for processing a light-sensitive silver halide photographic material according to claim 12, wherein the color developing agent is at least one of an aminophenol and a p-phenylenediamine type derivative.

15. The method for processing a light-sensitive silver halide photographic material according to claim 14, wherein the aminophenol type derivative is at least one selected from the group consisting of o-aminophenol, p-aminophenol, -amino-2-hydroxytoluene, 2-amino-3-hydroxytoluene and 2-hydroxy-3-amino-1,4-dimethylbenzene.

16. The method for processing a light-sensitive silver halide photographic material according to claim 14, wherein the p-phenylenediamine type derivative is N,N-dialkyl-p-phenylenediamine type compound.

17. The method for processing a light-sensitive silver halide photographic material according to claim 14, wherein the N,N-dialkyl-p-phenylenediamine type compound is at least one selected from the group consisting of N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)toluene, N-ethyl-N-(-methanesulfonamido-ethyl-3-methyl-4-aminoaniline sulfate, N-ethyl-N-(-hydroxyethyl-aminoaniline, 4-amino-3-methyl-N,N-diethylaniline and 4-amino-N-(2-methoxyethyl)-N-ethyl-3-methylaniline-p-toluene-sulfonate.

18. The method for processing a light-sensitive silver halide photographic material according to claim 1, wherein the temperature of the color developer is 15° C. or higher.

19. The method for processing a light-sensitive silver halide photographic material according to claim 18, wherein the temperature of the color developer is within the range of 20 to 50° C.

20. The method for processing a light-sensitive silver halide photographic material according to claim 19, wherein the temperature of the color developer is 30° C.

21. The method for processing a light-sensitive silver halide photographic material according to claim 1, wherein the pH value of the color developer is 7 or higher.

22. The method for processing a light-sensitive silver halide photographic material according to claim 21, wherein the pH value of the color developer is within the range of about 10 to about 13.

* * * * *

UNITED STATES PATENT AND TRADEMARK OFFICE

CERTIFICATE OF CORRECTION

PATENT NO. : 5,085,978

DATED : February 04, 1992

INVENTOR(S) : Makoto Kajiwara et al.

It is certified that error appears in the above-identified patent and that said Letters Patent is hereby corrected as shown below:

Title Page, below the Abstract, change "11 claims" to --22 claims--.

Claim 1, column 25, line 42, before "hydrophilic" insert --a--.

Claim 15, column 29, line 40, change "-amino-2-hydroxytoluene" to --5-amino-2-hydroxytoluene--.

Claim 17, column 30, line 15, change "(-" to --β- --.

Claim 17, column 30, line 16, change "-(-" to -- -β- --.

Signed and Sealed this

Twenty-ninth Day of June, 1993

Attest:

Michael K. Kirk

MICHAEL K. KIRK

Attesting Officer

Acting Commissioner of Patents and Trademarks